United States Patent [19]

Schwarz

[11] Patent Number: 4,458,725

[45] Date of Patent: Jul. 10, 1984

[54] APPARATUS FOR COUPLING A WEAVING MACHINE AND SHED-FORMING MACHINE FOR EFFECTING PICK FINDING AND SLOW SPEED OPERATION

[75] Inventor: Rudolf Schwarz, Zurich, Switzerland

[73] Assignee: Staeubli Ltd., Horgen-Zuerich, Switzerland

[21] Appl. No.: 313,127

[22] Filed: Oct. 20, 1981

[30] Foreign Application Priority Data

Oct. 21, 1980 [CH] Switzerland ..... 7843/80

[51] Int. Cl.[3] ..... D03D 51/00

[52] U.S. Cl. ..... 139/1 E; 139/336

[58] Field of Search ..... 139/1 E, 1 R, 336, 66 R, 139/59; 192/48.91, 17, 0.094, 99 A

[56] References Cited

U.S. PATENT DOCUMENTS 3,828,824 8/1974 Macho ..... 139/1 E
4,244,399 1/1981 Palav et al. ..... 139/1 E

FOREIGN PATENT DOCUMENTS 436108 12/1974 U.S.S.R. ..... 139/336
785388 12/1980 U.S.S.R. ..... 139/1 E

*Primary Examiner*—James Kee Chi
*Attorney, Agent, or Firm*—Flynn, Thiel, Boutell & Tanis

[57] ABSTRACT

In a pick finder, a gear which is driven by a motor sits on a sleeve, which has thereon a tooth of a single-tooth coupling. For tensioning the return spring which effects engagement of the coupling, the gear has on the front side an annular control cam surface with recesses and cams, and rigid rollers can be brought into contact therewith through axial movement thereof with respect to the shaft. Based on the size and the placement of the respective rollers, engagement thereof with the cam surface on the gear rotated by the drive motor of the pick finder will move the sleeve into a position for pick finding or for slow-speed run of the weaving machine with the shed-forming machine. At the same time, the return spring is tensioned by the force of the motor.

14 Claims, 8 Drawing Figures

APPARATUS FOR COUPLING A WEAVING MACHINE AND SHED-FORMING MACHINE FOR EFFECTING PICK FINDING AND SLOW SPEED OPERATION

CROSS-REFERENCE TO RELATED APPLICATION

This application is related to a co-pending application entitled "PICK-FINDING MECHANISM WITH CREEPING SPEED", Ser. No. 313,128, filed concurrently herewith.

FIELD OF THE INVENTION

This invention relates to an apparatus provided in the drive train between a weaving machine and a shed-forming machine for effecting pick finding and slow-speed operation and, more particularly, to such an apparatus having an auxiliary motor, a coupling, and a return spring which urges the coupling into engagement.

BACKGROUND OF THE INVENTION

A shed-forming machine is, for pick finding, rotated slowly in a conventional manner by an auxiliary motor through a shiftable reduction gearing. The basic element of each pick-finding mechanism which is arranged between a weaving and a shed-forming machine is a single-tooth claw coupling, which assures that the weaving and shed-forming machines for the further weaving process cannot again be switched together phase-shifted. This single-tooth coupling is constructed relatively strong, namely, a great overlapping of the teeth exists to reduce the flank pressure. Furthermore, only a short time interval exists for effecting re-coupling, namely, the moment when the rotating teeth are aligned. Therefore, a strong spring is built into the pick-finding mechanism, which spring effects a timely and quick recoupling operation.

The strong spring is tensioned by operation of the pick-finding mechanism, which occurs preferably simultaneously with the uncoupling operation, which in turn is carried out by operation of either a switch lever of the pick-finding mechanism or an electromagnet. This tensioning of the spring requires considerable forces which, when tensioning with a switch lever, is a strong load on the operator and, during tensioning with an electromagnet, demands a voluminous electromagnet. Also, it is disadvantageous that the electromagnet works very suddenly, which results in additional loads on the gearing. However, the latter operation does have the advantage that the operation of the electromagnet by means of a push button can be released from any point of the weaver stand.

It is also possible to use the pick-finding mechanism with its motor for the slow-speed, called the creeping speed, operation of a weaving and shed-forming machine. Here too, at the end of the operating process, re-engagement of the coupling is effected by means of an initially tensioned spring.

A goal of the invention is therefore to provide a mechanism which assures a simple mechanical or electromagnetic but not too sudden disengagement of the coupling, with a simultaneous tensioning of the return spring for effecting the re-engagement of the coupling, and without requiring substantial physical effort of the operating personnel.

SUMMARY OF THE INVENTION

This purpose is achieved by providing an apparatus of the above-mentioned type, which is characterized inventively by the provision of a mechanism which effects the tensioning of the return spring through the drive movement of the motor.

A preferred embodiment is a pick-finding mechanism which includes the two-part single-tooth coupling being arranged on a shaft, wherein one part of this coupling is supported axially movably against the force of the return spring and is constructed as a sleeve which is movable on the shaft, and includes a drive gear driven by the motor and supported on the sleeve for limited axial and rotatable movement, preferably against the force of a second stronger spring, the drive gear having on the front side a control cam with at least one axially projecting cam, and including a stop or roller which is arranged on the housing of the apparatus and can be moved into engagement with the cams.

To separate the coupling for starting the pick-finding operation, the operator needs only to move one of the stops into the space between two cams and to permit the motor of the pick finder to run. Uncoupling will then occur automatically and the spring will be initially tensioned for coupling, because the cam will run onto the stop and move the sleeve. The tensioning thus takes place impact-free, by utilizing the motor output. The movement of the stop into the region of the cams can be done manually, or by means of an electromagnet.

BRIEF DESCRIPTION OF THE DRAWINGS

One exemplary embodiment of the invention is illustrated in the drawings, in which.

DETAILED DESCRIPTION

Figure 1:
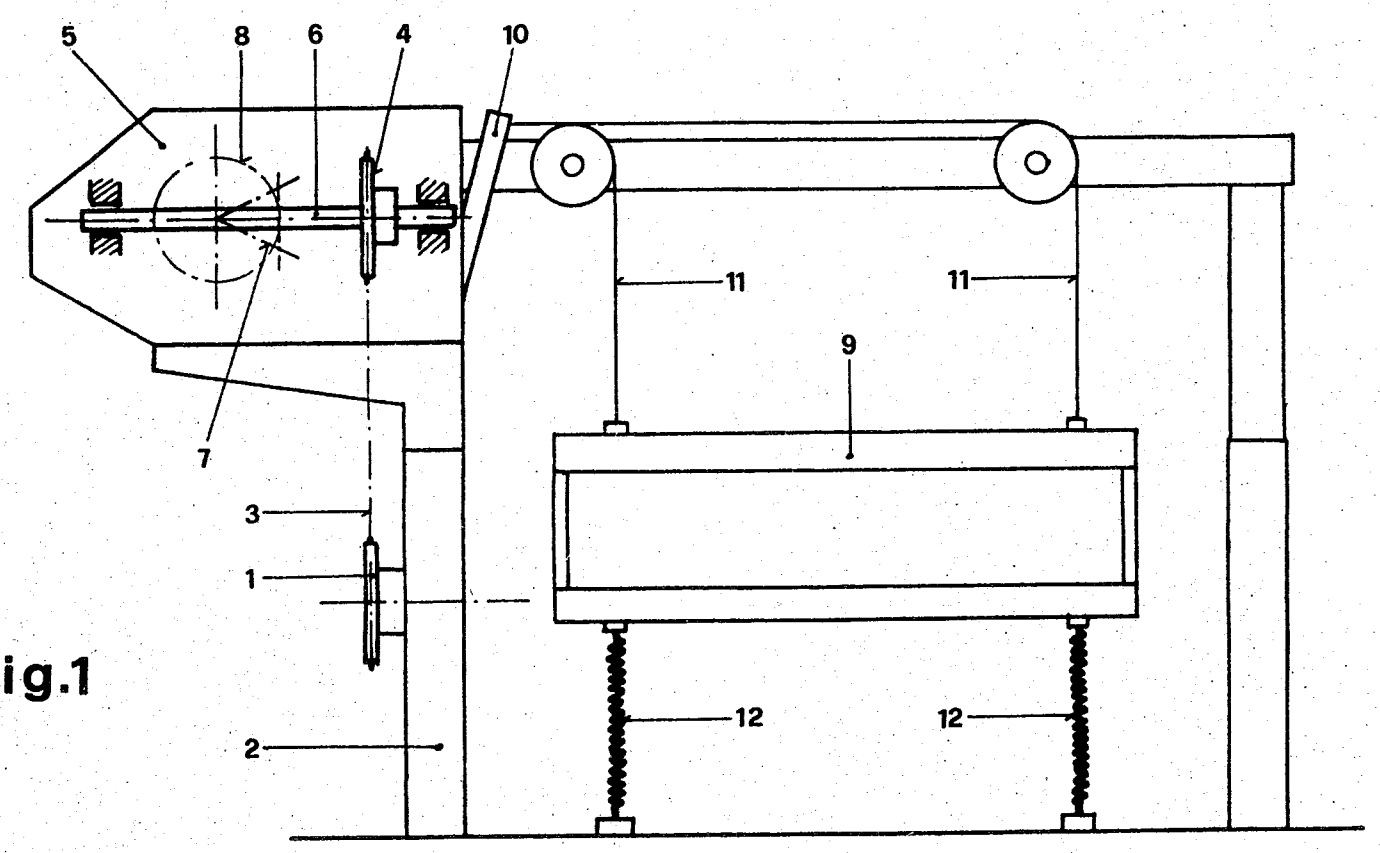
FIG. 1 illustrates a weaving machine having a shed-forming machine attached thereto.

FIG. 1 illustrates a weaving machine 2, to which is connected a dobby 5. The dobby 5 is driven by a sprocket wheel 1 on the drive shaft of the weaving machine 2 through a chain 3 which is shown in broken lines and a sprocket wheel 4 which is rotatably supported on a shaft 6 of the dobby 5. The sprocket wheel 4 drives the shaft 6 and two bevel gears 7 and 8 of the dobby 5, shown in broken lines, through a not illustrated coupling which is described hereinafter in connection with FIGS. 2–8. A heddle frame 9 can be pulled up against the force of return springs 12 by a rocking lever 10 of the dobby 5 through the heddle-frame actuating cables 11.

The pick-finding mechanism of FIGS. 2–5 is provided on the shaft 6 which is rotatably supported in a conventional manner in shields or sidewalls of the housing 13 of the dobby. It includes the drive sprocket wheel 4 which is rotationally driven by the weaving machine in the manner just described and is fixedly secured on a carrier sleeve 14, one side of which has a claw or tooth 16 which is part of the single-tooth coupling. The sleeve 14 is supported rotatably, but not axially movably, on the shaft 6.

The tooth 16 cooperates with a tooth 17 provided on an axially movable sliding support element or sleeve 18, which is fixed against rotation with respect to the shaft 6 by a key 19. The sliding sleeve 18 in turn rotatably supports a sleeve arrangement which includes a sleeve 15 and a gear 21. The sleeve 15 is rotatably supported the sleeve 18 and in turn rotatably supports the gear 21 which is operatively engaged with the pinion gear 23 of a drive motor 24 for the pick finder. The gear 21 is supported on the sleeve 15 in such a manner that they are capable of relative rotation, limited by the friction effect caused by the action of a tensioned spring 20. The spring 20 is secured at one end against a lateral movement relative to the sleeve 15 by a ring 22, and the other end presses the gear 21 firmly against a shoulder 25 of the sleeve 15. The gear 21 can be moved to the left, together with the sleeve 15 and the sliding sleeve 18, so that the coupling teeth 30 on the side of the sleeve 15 engage the coupling gaps 31 provided in the bevel gear 7, which is fixedly secured on the shaft 6. The axial movability and the friction connection between gear 21 and sleeve 15 produced by the spring 20 provide a safety feature to prevent an overload on the motor, gearing and rollers, for example if the teeth 30 cannot immediately be moved into engagement with the gaps 31.

Relatively axial movement of the sleeve 15 and the sleeve 18 is prevented by an axially facing shoulder 18A (FIG. 2) on the sleeve 18 which engages one end of the sleeve 15 and a ring 41 on the sleeve 18 which engages the opposite end of the sleeve 15. The rings 22 and 41 are preferably split rings which engage circumferential grooves provided in the surfaces of the sleeves 15 and 18, respectively.

A relatively strong helical spring 39 encircles the shaft 6 and has one end disposed against the sleeve 18 and the other end disposed against the bevel gear 7.

The sleeves 15 and 18 and the gear 21 thus form a coupling part movable axially of the shaft 6 between positions operatively engaged with the sleeve or coupling part 14 and the gear or coupling part 7.

The gear 21 has an annular, axially projecting ring 26 on one side thereof, which ring concentrically encircles the shaft 6 and has on its free end a control cam surface 27. The cam surface 27 consists of cams 28 and recesses 29 which are arranged therebetween, the cams 28 and recesses 29 being connected with one another by ramp surfaces 40.

A control arrangement includes plunger rods 32 which are supported for reciprocal axial movement in directions radially of the shaft 6 by bearings 38 of the housing 13. The rods 32 have at their respective upper ends stop rollers 33 and 34 with differing diameters. More specifically, the roller 33 is of greater diameter than the rollers 34, and the rollers 34 are preferably of equal diameter. The lower end of each rod 32 has a head 35 against which a spring 36 is supported. For electromagnetic operation of the rods 32, for example as a plunger-type armature, each is made of iron and is placed in the spool or coil 37 of an electromagnet. Each spring 36 has its upper end disposed against the bottom of the associated coil 37 and urges the associated rod 32 downwardly.

Figure 2:
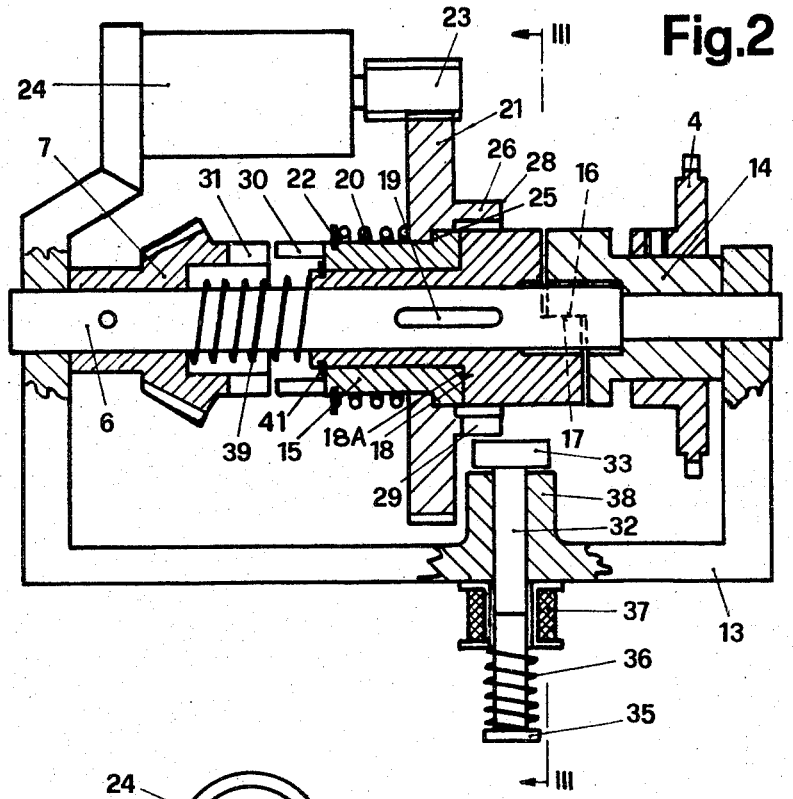
FIG. 2 is a longitudinal cross-sectional view of an inventive pick-finding mechanism in a "weaving" position.

For pick finding, the rod 32 with the large roller 33 is, after the motor of the weaving machine has been switched off, moved against the force of the spring 36 toward the shaft 6, either manually or automatically by exciting the electromagnet coil 37. At the same time, the drive motor 24 of the pick-finding mechanism is switched on, which causes the gear 21 to rotate, and the roller 33 enters a recess 29 of a cam surface 27 as the recess 29 passes it. Further rotation of the gear 21 causes the ramp surface 40 of the cam surface 27 to run up onto the roller 33. Since the rod 32 and the roller 33 thereon are supported stationarily on the housing 13, the gear 21 in FIG. 2 is moved to the left, into the position according to FIG. 4. The gear 21 carries along, due to the spring 20, the retaining ring 22 and the sleeve 15, the sliding sleeve 18. The coupling 30 and 31 thus becomes engaged and the strong spring 39 is compressed. The force of the motor drive is thus used to tension the spring 39 which, after the pick-finding process has ended, effects re-engagement of the single-tooth coupling 16 and 17.

Figure 5:
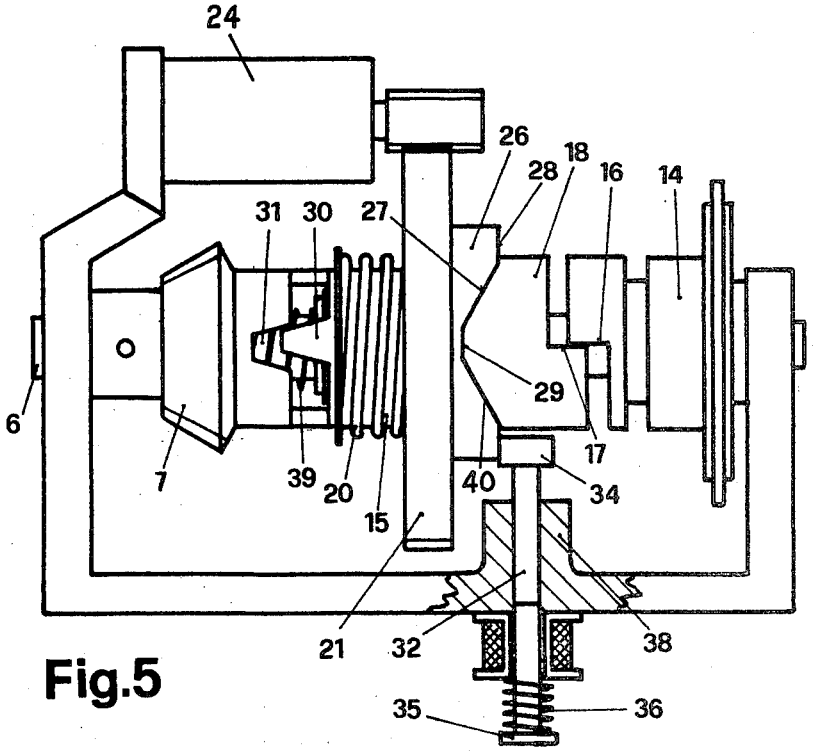
FIG. 5 is a fragmentary side view of the mechanism of FIG. 2 in a "slow-speed" position.

For the purpose of exacting observation of the sequence of machine operation and for stopping the machine in a selected position, the weaving machine and dobby are run slowly, namely at a creeping speed, for example 20 rpm, in a forward or reverse direction. For this, the two rods 32 with the smaller rollers 34 thereon are both moved radially inwardly to an actuating position by electrically actuating the associated coils 37, and at the same time the drive motor 24 of the pick-finding mechanism is switched on. The drive motor of the weaving machine is switched off, and the brake on the weaving machine is released. As one of the recesses 29 of the cam surface 27 passes the rollers 34, the rollers 34 enter and engage the recess 29 and the ramp surfaces 40 of the cams run onto the rollers 34. The sliding sleeve 18 is thereby moved to a position about halfway along its path of travel to the left, as shown in FIG. 5. In this position, the couplings 30 and 31 and 16 and 17 are both partially engaged. As long as the rods 32 having the rollers 34 thereon remain in the moved-in position, the weaving machine and dobby will be driven by the motor 24. When either one of the rollers 34 reaches the area of a recess 29 due to rotation of the gear 21, the other roller 34 will be resting on a cam 28 and maintain the lateral shift of the sleeve 18.

Figure 6:
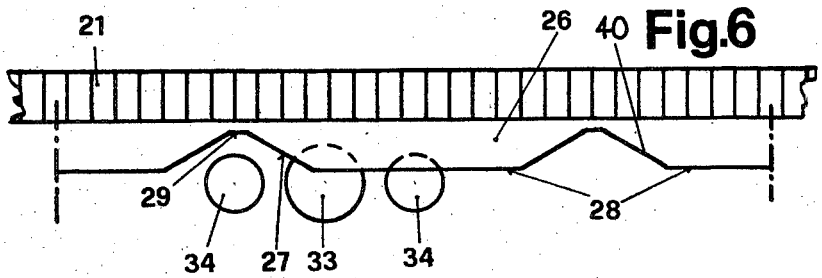
FIGS. 6 to 8 diagrammatically illustrate various operating positions of a drive gear, a control cam, and stop rollers which are components of the mechanism of FIG. 2.
Figure 7:
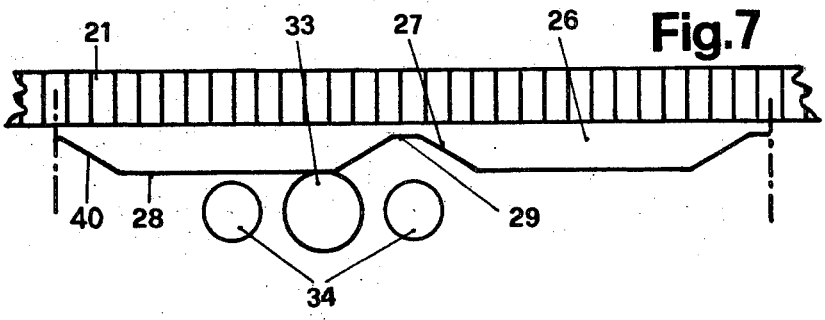
Figure 8:
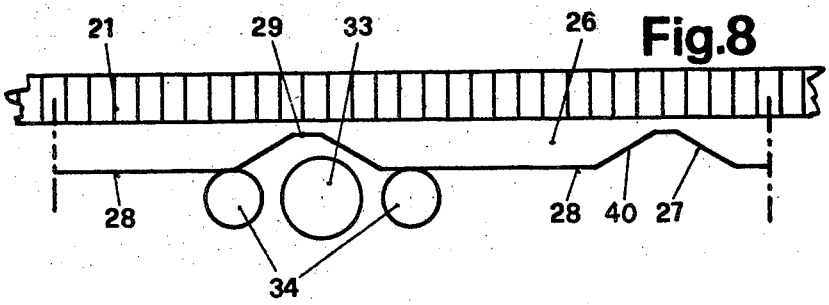

FIGS. 6–8 illustrate diagrammatically the various positions that the rollers 33 and 34 can assume with respect to the control cam surface 27.

Figure 3:
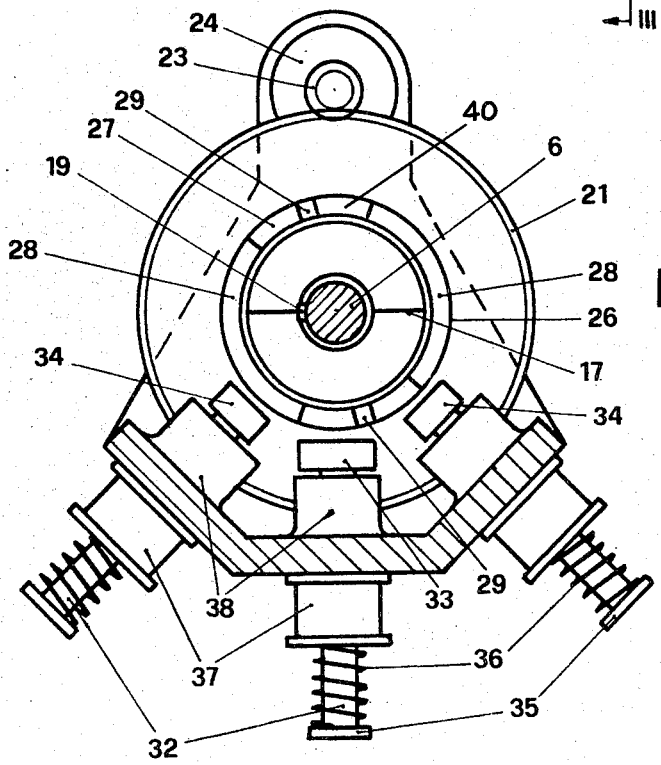
FIG. 3 is a sectional view taken along the line III—III of FIG. 2.

FIG. 6 corresponds to the position according to FIGS. 2 and 3, namely where none of the rods 32 are moved in and all of the rollers 33 and 34 are spaced radially outwardly from the cams 28 and recesses 29 on the ring 26.

Figure 4:
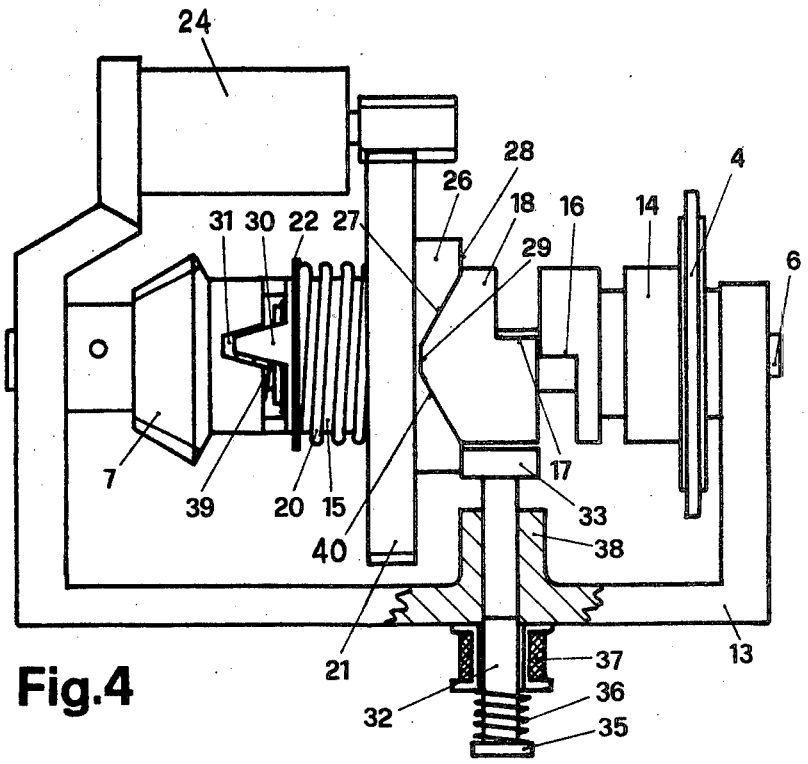
FIG. 4 is a fragmentary side view of the mechanism of FIG. 2 in a "pick-finding" position.

FIG. 7 corresponds to the "pick-finding" position according to FIG. 4, namely where the rod 32 with the large roller 33 thereon has moved in and the roller 33 engages the cam 28. The gear 21 has thus been moved axially by the roller 33. The rollers 34 are, at this time, without any function.

FIG. 8 corresponds to the position according to FIG. 5 for the slow speed of the coupled weaving machine and dobby. The two rods 32 with the smaller rollers 34 are moved in and the rollers 34 alternately or simultaneously engage the cams 28 as the gear 21 rotates. The gear 21 is displaced axially by the rollers 34 approximately half the distance that it is displaced in FIG. 7. The roller 33 is, at this time, without any function.

When the electricity supplied to a selected one of the electromagnets is turned off, the associated rod 32 is moved downwardly under the urging of the associated spring 36, moving the associated roller 33 or 34 to a retracted position in which it is out of engagement with the cam surface 27.

After the rods 32 are no longer held in the pushed-in position, the apparatus returns to the basic position, namely the weaving position of FIG. 2 from the positions of FIGS. 7 and 8 under the urging of the tensioned spring 39.

Thus, the force for tensioning the strong return spring 39 need not be produced manually for starting the pick finding or the slow-speed operation in the described apparatus, nor is a voluminous magnet needed for this. Rather, the moving in of the rods 32 having the rollers 33 and 34 thereon requires an extremely small force expenditure.

From the description in connection with FIGS. 6–8 of the sequence of movement of the gear 21 with the cams 28 thereon and thus the movement of the sleeve 18, it becomes clear that, in place of the rollers 33 and 34 of various diameters, it would also be possible to use rollers having uniform diameters. The plunger rods 32 must then be arranged so that their central axes are offset relative to each other in a direction axially along the shaft 6. More specifically, the axes of the two rods 32 which control the slow-speed operation must be farther from the control cam surface 27 in a direction axially of the shaft 6 than the rods 32 which control the pick-finding operation.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for operatively coupling a weaving machine and a shed-forming machine, comprising first and second coupling parts which are supported for rotation independently of each other about an axis and are supported for axial movement relative to each other between a first position in which said coupling parts are drivingly engaged and a second position in which said coupling parts are spaced from each other and free of driving engagement; first resilient means yieldably urging said first and second coupling parts toward said first position; an axially facing, annular cam surface provided on said first coupling part coaxial with said axis, said cam surface having an axially projecting cam portion, a recess portion and a ramp portion connecting said recess portion and said cam portion; drive means cooperable with said first coupling part for effecting rotation of said cam surface about said axis; an actuating member fixed against axial movement relative to said second coupling part and supported for movement substantially radially of said axis between a retracted position spaced from said cam surface and an actuating position substantially radially aligned with and engageable with said cam surface; and control means for selectively moving said actuating member between said retracted and actuating positions, rotation of said cam surface by said drive means when said actuating member is in said actuating position and in said recess portion of said cam surface causing said actuating member to move along said ramp portion to said cam portion of said cam surface and thus effect movement of said first coupling part toward said second position against the urging of said first resilient means.

2. The apparatus according to claim 1, wherein said control means includes an elongate rod extending substantially radially of said axis, supported for movement substantially radially of said axis and fixed against movement axially of said axis, said actuating member being a roller supported on said rod for rotation about an axis substantially parallel to the direction of movement of said rod; second resilient means cooperable with said rod for yieldably urging it toward a position in which said roller is in said retracted position; and selectively actuable electromagnetic means for facilitating movement of said rod against the urging of said second resilient means to a position in which said roller is in said actuating position.

3. The apparatus according to claim 1, including a third coupling part supported for rotation about said axis independently of and spaced from said second coupling part, said first coupling part being located between said second and third coupling parts and said first and third coupling parts being drivingly engaged when said first coupling part is in said second position.

4. The apparatus according to claim 3, wherein said first coupling part includes a support element which is supported for rotation about said axis and a sleeve arrangement supported on said support element for rotation about said axis independently of said support element, said cam surface being provided on said sleeve arrangement; and wherein said drive means includes a motor which is drivingly coupled to said sleeve arrangement, said support element and said second coupling part being drivingly coupled when said first coupling part is in said first position, and said sleeve arrangement and said third coupling part being drivingly coupled when said first coupling part is in said second position.

5. The apparatus according to claim 4, wherein said sleeve arrangement includes a sleeve supported on said support element for rotation independently thereof about said axis and fixed against axial movement relative to said support element, a gear supported on said sleeve for rotation about said axis independently of said support element and sleeve and supported for axial movement relative to said sleeve, and second resilient means yieldably urging said gear axially relative to said sleeve in a direction toward said second coupling part, said sleeve having stop means thereon for limiting axial movement of said gear relative to said sleeve in said direction, said motor having a shaft which extends substantially parallel to said axis and has a pinion thereon which drivingly engages said gear, said gear having said cam surface thereon, and friction between said gear and said sleeve yieldably resisting relative rotation thereof.

6. The apparatus according to claim 5, wherein said second resilient means includes a helical spring which encircles and has one end supported on said sleeve and has its other end supported on said gear.

7. The apparatus according to claim 5, wherein the weaving machine is drivingly coupled to said second coupling part, and wherein said third control part is drivingly coupled to said shed-forming machine.

8. The apparatus according to claim 7, wherein said support element and second coupling part each have a single coupling tooth thereon, said teeth being operatively engaged when said first and second coupling parts are in said first position.

9. The apparatus according to claim 7, wherein said third coupling part and said sleeve each have a plurality of teeth thereon which are operatively engaged when said first coupling part is in said second position.

10. The apparatus according to claim 5, including a rotatably supported shaft which is coaxial with said axis, said third coupling part being fixedly secured to said shaft and said second coupling part being rotatably supported on said shaft and fixed against axial movement relative thereto, said support element being a sleeve which is axially slidably supported on said shaft and fixed against rotation relative thereto.

11. The apparatus according to claim 10, wherein said first resilient means includes a helical spring which encircles said shaft between and has its ends respectively supported on said third coupling part and said support element.

12. The apparatus according to claim 5, including a further said actuating member movable between retracted and actuating positions, rotation of said cam surface when said further actuating member is in its actuating position causing said cam surface and said further actuating member to cooperate and effect movement of said first coupling part against the urging of said first resilient means to a third position which is between said first and second positions, said support element and said second coupling part being drivingly engaged and said sleeve and said third coupling part also being drivingly engaged when said first coupling part is in said third position.

13. The apparatus according to claim 12, wherein said first-mentioned and further actuating members are each a rotatably supported roller, the axes of rotation of said rollers extending substantially radially of said axis of rotation of said coupling parts and being substantially axially aligned, said first-mentioned actuating member having a diameter which is greater than the diameter of said further actuating member.

14. The apparatus according to claim 1, including two said actuating members which are located at angularly spaced locations about said axis, said control means being adapted to simultaneously maintain both of said actuating members in said actuating positions thereof.

* * * * *